United States Patent [19]

Löwenheck

[11] 4,118,978

[45] Oct. 10, 1978

[54] THREAD TENSION GAGE

[75] Inventor: Konrad Löwenheck, Basel, Switzerland

[73] Assignee: N. Civy & Cie, SA, Oberwil, Switzerland

[21] Appl. No.: 826,558

[22] Filed: Aug. 22, 1977

[30] Foreign Application Priority Data

Sep. 3, 1976 [CH] Switzerland ..... 11218/76

[51] Int. Cl.[2] ..... G01L 5/06

[52] U.S. Cl. ..... 73/144

[58] Field of Search ..... 73/144

[56] References Cited

U.S. PATENT DOCUMENTS

| | | | |
|---|---|---|---|
| 2,159,969 | 5/1939 | Furst | 73/144 |
| 2,564,150 | 8/1951 | Brown | 73/144 |
| 3,495,454 | 2/1970 | Heimes | 73/144 |

*Primary Examiner*—Charles A. Ruehl
*Attorney, Agent, or Firm*—Hans Berman

[57] ABSTRACT

A sensing rod and two parallel guide rods project from the housing of a thread tension gage dimensioned to be carried in one hand and operated by pressure of one finger on a push-button which causes the threat-engaging end portions of the guide rods to advance into a common plane with the corresponding portion of the sensing rod. Further push-button movement causes the guide rods to wrap the tested thread over a portion of the sensing rod circumference, and the force of the tensioned thread deflects the sensing rod which is mounted on a torsion spring. The deflection of the sensing rod can be read from a scale calibrated in units of the thread tension.

10 Claims, 6 Drawing Figures

FIG. 2
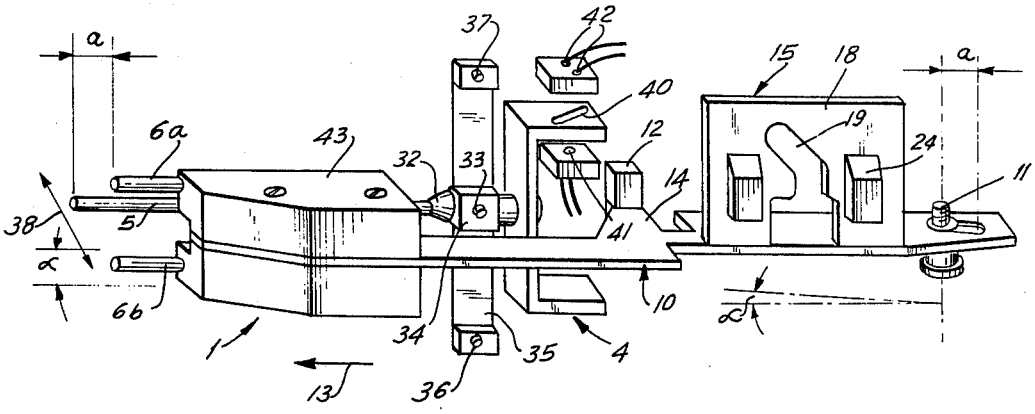
FIG. 3
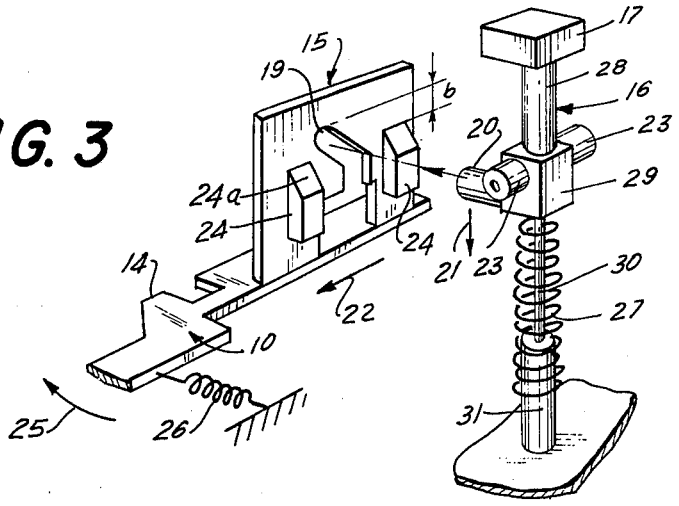
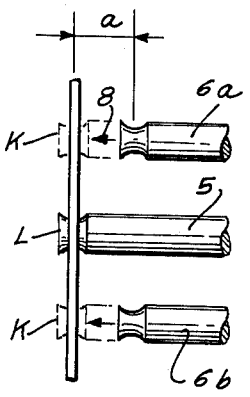
FIG. 4
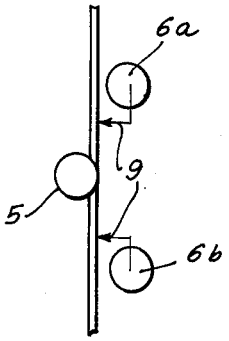
FIG. 5
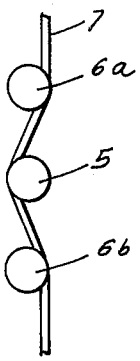
FIG. 6

THREAD TENSION GAGE

This invention relates to the measurement of tension in longitudinally moving threads or yarns, and particularly to a self-contained thread tension gage which includes a sensing head and a device for generating a sensible signal indicative of the sensed thread on a common support.

The tension under which yarns or threads move through textile processing equipment, such as looms and knitting machines, decisively affects the properties of the resulting fabrics or other products, and various types of thread tension gages are in common use. They may be installed permanently on the textile processing machines, or be portable for monitoring the performance of several pieces of equipment.

It is a common shortcoming of the portable thread tension gages in current use that they are relatively bulky and not capable of being carried and operated by one hand. Their sensing heads often are constructed in such a manner that only a highly skilled operator can engage them with the moving threads or yarns whose tension is to be measured, and which are not always located where they would be readily accessible.

A primary object of this invention is the provision of a portable thread tension gage which makes it relatively easy to engage its sensing head with a yarn or thread traveling at high speed through an area of limited accessibility. Another important object is the provision of such a gage which may be operated readily by only one hand.

With these objects in view, the thread tension gage of the invention, in its more specific aspects, has a sensing head mounted on a support and including a sensing member and two guide members. Respective thread engaging portions of the three members are spaced from each other in all operating conditions of the gage. A manually operable mechanism on the support permits the thread engaging portions of the two guide members to be moved relative to the corresponding portion of the sensing member from a first to a second position in a first direction, and thence to a third position in a second direction. In the second and third positions of the guide members, the several thread engaging portions of the three members extend in a common plane in which the portions of the guide members define a straight line therebetween. In the third position, the thread engaging portion of the sensing member intersects this line, but is offset from the line in the second position. The aforementioned first direction of guide member movement is transverse to the common plane. A sensible signal indicative of a force exerted on the thread engaging portion of the sensing member in the common plane transverse to the straight line referred to above is generated and indicates tension in a thread or yarn simultaneously engaged by the three members of the sensing head in their third position and wrapped about a portion of the sensing member.

Other features, additional objects, and many of the attendant advantages of this invention will readily be appreciated as the same becomes better understood by reference to the following detailed description of a preferred embodiment when considered in connection with the appended drawing in which:

FIG. 2 is a perspective view of operating elements of the gage, partly obscured by a housing in FIG. 1;

FIG. 3 shows operating elements of the gage, partly omitted from FIG. 2, in an exploded, perspective view;

FIG. 4 illustrates the cooperation of sensing elements of the gage with a thread in a first stage of the tension measuring operation in side elevation; and FIGS. 5 and 6 are simplified views of the device of FIG. 4 in second and third operating stages in front and rear elevation respectively.

Figure 1:
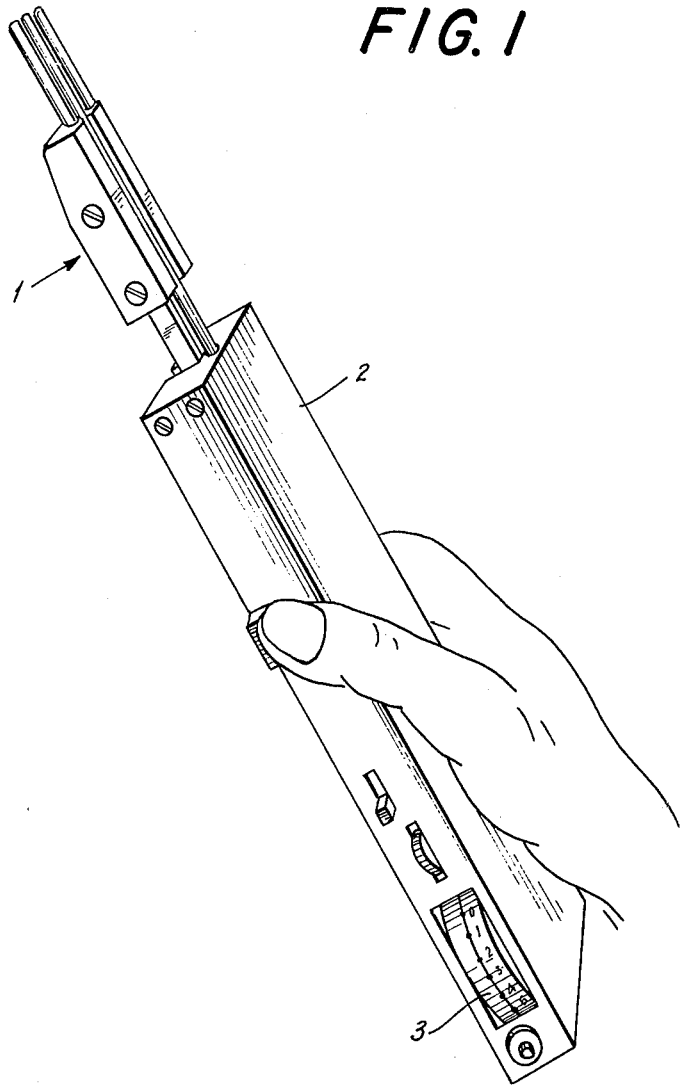
FIG. 1 shows a hand-held thread tension gage of the invention in a perspective view.

Referring now to the drawing in detail, and initially to FIG. 1, there is seen a thread tension gage of the invention as it is held in the hand of an adult operator. A sensing head 1 projects longitudinally from an elongated, supporting housing 2 which is gripped by the operator's hand. The operator's thumb rests on a push button 17 to be described in greater detail hereinbelow. The gage is battery operated in a conventional manner not fully illustrated when a main switch 44 is closed. A window 3 in the supporting housing 2 reveals the movable scale of a galvanometer calibrated in units of thread tension. A push button switch 45 permits the condition of the nonillustrated battery to be read from the galvanometer scale, and the knurled handwheel 46 of a rheostate may adjust the electrical indicating circuit to the available output voltage of the battery in a manner known in itself.

As is better seen in FIG. 2, the sensing head 1 mainly consists of a sensing rod 5 and two guide rods 6*a*, 6*b*. The three rods are cylindrical over most of their respective lengths, and their axes extend in a common direction in all operative conditions, deviating from a strictly parallel relationship at most by a very small, acute angle $\alpha$. The rods 6*a*, 6*b* are attached in parallel alignment to one end of a rocker arm 10 of sheet material by metal blocks 43 which increase the inertia of the rocker assembly. The other end of the rocker arm 10 has a longitudinal slot of length *a*. A pivot pin 11 fixed on the housing 2 in a manner not specifically illustrated is received in the slot. In the illustrated longitudinal position of the arm 10, angular movement of the arm on the pivot pin 11 away from the viewer is prevented by an abutment 12 on the housing 2 engaging a lug portion 14 of the arm 10.

The motion of the push-button 17 under the pressure of the operator's thumb is translated into translatory movement of the rocker arm 10, as indicated by the arrow 13, and into angular movement through the angle $\alpha$ by a motion transmitting assembly 15 which includes a sheet metal flange 18 projecting at right angles from the arm 10 between the lug 14 and the pivot pin 11. A guide slot 19 in the flange 18 is inclined at an angle of approximately 45° to the direction of elongation of the arm 10. Two cams 24 are fastened to the same face of the flange 18 on opposite sides of the guide slot 19.

As is shown in FIG. 3, the motion transmitting assembly 15 is coupled to an actuating assembly 16 of which only the push button 17 is visible outside the housing 2. The stem 28 of the push button is fixedly fastened to one face of an approximately cubical connector 29. A guide bar 30 projects from the opposite face of the connector 29 into a guide sleeve 31 fixed on the housing 2 and thus limits the push button 17 to translatory, practically rectilinear movement. A helical compression spring 27 is coiled about the bar 30 between the sleeve 31 and the connector 29 to bias the push button 17 outward of the housing 2. A cylindrical guide pin 20 on the connector 29 is cammingly received in the slot 19 in the assembled condition of the gage, and two cam follower rollers 23 travel over the face of the flange 18 laterally of the slot 19 when the push button 17 is depressed as indicated by the arrow 21. After moving a distance *b* from their normal rest position, the rollers 23 move over obliquely inclined faces 24*a* of the cams 24 and swing the arm 10 about the pin 11 as indicated by an arrow 25, the arm having previously been shifted longitudinally by the guide pin 20 in the direction of the arrow 22 a distance sufficient to make the abutment 12 clear the lug portion 14. A helical tension spring 26 holds the flange 18 and the cams 24 in contact with the rollers 23 at all times.

An enlarged part 32 of the sensing rod 5 in the housing 2 is fixedly fastened to the center of a leaf spring 35 by a clamp 34 and a screw 33, as is shown in FIG. 2. The two ends of the spring 35 are attached to the housing 2 by screws 36, 37 so that the spring is stressed in torsion when the free end of the rod 5 moves angularly about an axis through the screws 36, 37 as indicated by a double arrow 38. The mass of the rod 5 extending outward of the housing 2 from its axis of angular movement is balanced by the mass of a U-channel section 39 whose web is attached to the rod part 32. The channel section 39 constitutes the sole movable element of a signal generating device 4. One of the flanges of the channel section 39 is provided with a diagonal slot 40. A small electric lamp 41 and two photo diodes 42 are arranged on opposite sides of the slotted flange in such a manner that the light of the bulb 41 reaches the diodes 42 in different ratios depending on the angular position of the sensing rod 5. The diodes 42 are arranged in a conventional bridge circuit, not shown, with the galvanometer partly seen in the window 3 (FIG. 1) so that the position of the galvanometer scale varies with the position of the rod 5.

In the rest position of the gage illustrated in FIGS. 1, 2, and also in FIG. 4 in fully drawn lines, the transverse face L on the free end of the sensing rod 5 projects longitudinally beyond the end faces K,K of the guide rods 6*a*, 6*b* by a distance *a* equal to the available stroke of the pivot pin 11 in the associated slot of the rocker arm 10. The sensing rod 5 may swing about its axis of angular movement approximately in a plane of symmetry defined by the guide pins 6*a*, 6*b* and is normally held in a position of minimal stress in the spring 35 in which the free end of the sensing rod 5 is laterally offset from a straight line through the free ends of the guide rods 6*a*, 6*b*, in a manner best seen in FIG. 5. The free ends of the rods 5, 6*a*, 6*b* are formed with circumferential grooves of circularly arcuate cross section which are shown in FIG. 4 only.

When the tension in a thread 7 is to be measured, the gage is moved toward the thread until the same is received in approximately tangential relationship in the groove near the end face L of the sensing rod 5 which projects beyond the guide rods by more than the common diameter of the latter, as is shown in FIG. 4. When the push button 17 then is pressed, the rocker arm 10 is moved longitudinally, and the guide rods 6*a*, 6*b* move simultaneously in the direction of the arrow 8 until they reach their positions indicated in broken lines in FIG. 4 in which their thread engaging end portions extend in a common plane with the corresponding portion of the sensing rod 5. At this stage, the sensing rod 5 is still offset from the straight line defined by the axes of the rods 6*a*, 6*b*, as is shown in FIG. 5. During the subsequent swinging movement of the rocker arm 10, the guide rods 6*a*, 6*b* engage the thread 7 and wrap the thread over a portion of the circumference of the sensing rod. The sensing rod 5 is angularly deflected against the torsional resistance of the leaf spring 35 by the tension of the thread 7, and a numerical indication of this tension may be read in the window 3.

While it is sufficient to swing the rocker arm 10 until the thread engaging end portion of the sensing rod 5 intersects the straight line defined in the afore-mentioned common plane by the end portions of the guide rods 6*a*, 6*b*, the guide rods may be moved farther toward the right, as viewed in FIG. 6, or toward the left, as viewed in FIG. 5 to increase the angle of wrap of the thread 7 about the sensing rod 5, and the calibration of the scale in the window 3 will be chosen accordingly. Yet, the ultimate relative position of the rods 5, 6*a*, 6*b* cannot be reached without at least passing through the position of FIG. 6.

The leaf spring 35 provides a particularly simple and effective torsion spring that limits angular movement of the sensing rod 5 to a plane at least approximately equidistant from the two guide rods 6*a*, 6*b*, but other torsion springs may be employed and supplemented by guides as needed. The use of torsion bars or piano wires stressed in torsion during angular diplacement of the sensing rod 5 is specifically contemplated.

The channel section 39 provides a compact counterweight whose mass balances that of the longitudinal portion of the rod 5 extending in the opposite direction from the axis of angular rod movement through the screws 36, 37. The channel section 39 causes the center of gravity of the sensing rod assembly to be located in the last-mentioned axis. The position of the gage relative to the field of terrestrial gravity thus has no effect on the precision and accuracy of the tension readings presented in the window 3. The slotted flange of the channel section 39 simultaneously functions as a baffle which varies the ratio of the respective portions of light from the lamp 41 which reach the diodes 42. Photodiodes require but a minimum of space and are preferred in the gage of the invention, but other photoelectric elements may be substituted without major change in function.

A numerical indication of thread tension is preferred, in a yarn tension gage which is to be used alternatively on different machinery and/or on different textile materials. Where a battery of machines operating at the same nominal thread or yarn tension is to be inspected, a go-no-go gage is adequate or even preferable, and the sensible signal generated in response to the angular movement of the sensing rod 5 may be provided by one or two pilot lamps, or even by a buzzer instead of the galvanometer described and illustrated.

A photoelectric signal generator has obvious advantages in cooperation with a sensing rod whose movement is limited only by a torsion spring. Electromechanical transducers of different types have been used in this field and may be resorted to in an obvious manner.

It should be understood, therefore, that the foregoing disclosure relates only to a preferred embodiment of the invention, and that it is intended to cover all changes and modifications of the example of the invention chosen herein for the purpose of the disclosure which do not constitute departures from the spirit and scope of the invention set forth in the appended claims.

What is claimed is:

1. A thread tension gage comprising:

(a) a support;

(b) a sensing head on said support including a sensing member and two guide members, said sensing and guide members having respective thread-engaging portions spaced from each other;

(c) manually operable moving means on said support for moving said portions of said guide members relative to said portion of the sensing member from a first position to a second position in a first direction and thereafter from said second position to a third position in a second direction;

(1) said portions of said sensing and guide members extending in a common plane is said second and third positions, (2) said portions of said guide members defining a straight line therebetween when in said common plane, and said portion of said sensing member intersecting said line in said third position, (3) said first direction being transverse to said plane, (4) said portion of the sensing member being offset in said second direction from said straight line in said second position; and (d) signal generating means on said support for generating a sensible signal indicative of a force exerted on said portion of said sensing member in said common plane transverse to said straight line.

2. A gage as set forth in claim 1, wherein said members are elongated in said first direction and longitudinally project from said support, said thread-engaging portions being longitudinally terminal of the respective members, the two thread engaging portions of said guide members, when in said first position, being spaced from said common plane toward said support a distance greater than the greatest dimension of said two portions transverse to the direction of elongation of said guide members.

3. A gage as set forth in claim 1, wherein said moving means include an actuating member accessible on said support for manual operation, and motion transmitting means operatively connecting said actuating member to said guide members for sequentially moving the guide members from said first position to said second position and thence to said third position during continuous movement of said actuating member in one direction.

4. A gage as set forth in claim 3, wherein said continuous movement is translatory and substantially rectilinear.

5. A gage as set forth in claim 3, wherein said motion transmitting means include cooperating first cam means operatively connected to said actuating member and to said guide members for moving the guide members from said first position to said second position during a first portion of said continuous movement, and cooperating second cam means operatively connected to said actuating member and to said guide members for moving the guide members from said second position to said third position during a second portion of said continuous movement.

6. A gage as set forth in claim 3, wherein said motion transmitting means include a rocker member having a first portion mounted on said support for limited movement in said first direction, and a second portion spaced from said first portion and carrying said guide members, said first portion being angularly movable on said support for movement of said second portion in said second direction.

7. A gage as set forth in claim 1, wherein said signal generating means include a light source, and two photoelectric elements mounted on said support, and baffle means interposed between said source and said elements, said sensing member being mounted on said support for limited movement in said second direction in response to the exerted force, said signal generating means further including biasing means resiliently opposing said limited movement, said baffle means being operatively connected to said sensing member for varying the ratio of the respective portions of said light reaching said elements from said source in response to said limited movement.

8. A gage as set forth in claim 7, wherein said biasing means include a spring member mounted on said support and fastened to said sensing member for torsional stressing of said spring member by said limited movement.

9. A gage as set forth in claim 1, wherein said support is dimensioned to fit into the hand of an adult human operator, and said moving means include an actuating member mounted on said support for movement toward and away from a position in which said actuating member projects from said support and is within reach of a finger of said hand, and yieldably resilient means biasing said actuating member toward said position thereof.

10. A gage as set forth in claim 1, further comprising a resilient member mounted on said support, said sensing member being elongated and having two longitudinally terminal portions, one of said terminal portions constituting said thread-engaging portion of said sensing member, said resilient member securing a portion of said sensing member intermediate said terminal portions to said support for limited angular movement of said sensing member about an axis transverse to the direction of elongation of said sensing member in response to said exerted force, said resilient member opposing said limited movement and being torsionally stressed by said limited movement, the longitudinal portions of said sensing member extending from said transverse axis in opposite directions being approximately equal in mass.

* * * * *